US006268414B1

(12) United States Patent
Lin

(10) Patent No.: US 6,268,414 B1
(45) Date of Patent: Jul. 31, 2001

(54) PAPER SIZING COMPOSITION

(75) Inventor: Tingdong Lin, Wilmington, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 09/293,051

(22) Filed: Apr. 16, 1999

(51) Int. Cl.[7] ..... C08J 5/10; C08K 5/13; C08L 99/00

(52) U.S. Cl. ..... 524/72; 524/73; 524/47; 524/437; 162/158; 162/163; 162/179

(58) Field of Search ..... 524/72, 73, 47, 524/48, 49, 50, 51, 52, 53, 434, 435, 436, 437; 162/158, 179, 163

(56) References Cited

U.S. PATENT DOCUMENTS

| | | | | |
|---|---|---|---|---|
| 3,223,544 | | 12/1965 | Savina . | |
| 3,637,407 | | 1/1972 | Schobinger et al. . | |
| 4,019,995 | * | 4/1977 | Briggs et al. | 252/62.53 |
| 4,040,900 | | 8/1977 | Mazzarella et al. . | |
| 4,240,935 | | 12/1980 | Dumas . | |
| 4,243,481 | * | 1/1981 | Dumas | 162/158 |
| 4,279,794 | | 7/1981 | Dumas . | |
| 4,295,931 | | 10/1981 | Dumas . | |
| 4,317,756 | | 3/1982 | Dumas . | |
| 4,470,742 | | 9/1984 | Schindler . | |
| 4,478,682 | | 10/1984 | Bankert et al. . | |
| 4,522,686 | | 6/1985 | Dumas . | |
| 4,654,386 | | 3/1987 | Hara et al. . | |
| 4,657,946 | | 4/1987 | Rende et al. . | |
| 4,861,376 | | 8/1989 | Edwards et al. . | |
| 5,145,522 | | 9/1992 | Nakagawa et al. . | |
| 5,167,849 | | 12/1992 | Seeholzer et al. . | |
| 5,171,795 | | 12/1992 | Miller et al. . | |
| 5,286,412 | * | 2/1994 | Northley et al. | 252/352 |
| 5,433,776 | | 7/1995 | Dasgupta . | |
| 5,470,742 | | 11/1995 | Bull et al. . | |
| 5,614,597 | | 3/1997 | Bower . | |
| 5,627,224 | * | 5/1997 | Lyrmalm | 524/52 |
| 5,685,815 | | 11/1997 | Bottorff et al. . | |
| 5,714,552 | | 2/1998 | Bower . | |
| 5,766,417 | | 6/1998 | Brungardt . | |
| 5,779,464 | * | 7/1998 | Fan et al. | 423/244.08 |

FOREIGN PATENT DOCUMENTS

| | | |
|---|---|---|
| 418015 | 3/1991 | (EP) . |
| 629741 | 12/1994 | (EP) . |
| 1750069 | 12/1996 | (EP) . |
| 57-161197 | 10/1982 | (JP) . |
| 59-199900 | 11/1984 | (JP) . |
| 2-127594 | 5/1990 | (JP) . |
| 4-119194 | 4/1992 | (JP) . |
| 2-806563 | 7/1998 | (JP) . |
| 97/17491 | 5/1997 | (WO) . |
| 97/30218 | 8/1997 | (WO) . |

OTHER PUBLICATIONS

Borregaard Lignotech, *Introduction to Borregaard's Lignin Products*, pp. 2–7.
Borregaard Lignotech, "Dynasperse LCD," (Apr. 1997).
Borregaard Lignotech, "Lignosol SFX–65," (Apr. 1997).
Borregaard Lignotech, "Marasperse AG," (Apr. 1997).
English Language Abstract of JP–2–127594.
English Language Abstract of JP–2–806563.
English Language Abstract of JP–57–161197.
English Language Abstract of JP–59–199900.
English Language Abstract of JP–4–119194.
Borregaard Lignotech, "Norlig 12/12F," (Apr. 1997).
Calgon Corporation, "Merquat® 550," Dec. 1996.
Jiang, J.E., Abstract of "Chemical Characterization and Surface–Active Properties of Lignosulfates Isolated from Vanillin Black Liquor," North Carolina State University, Ph.D. thesis (1989).
Kao Corporation, *Surfactants A Comprehensive Guide*, First Edition, pp. 75–78.
Lignotech USA, Inc., *The Lignin Story*, pp. 1–9 and 12–19.
Reed Inc., *A Working Chemist's Guide to the Chemistry of Lignosulphates*, pp. 1–12.
Farley and Waser, in *The Sizing of Paper, Second Edition*, edited by W.F. Reynolds, Tappi Press, 1989, pp. 51–62.

* cited by examiner

*Primary Examiner*—Samuel A. Acquah
*Assistant Examiner*—U. K. Rajouru
(74) *Attorney, Agent, or Firm*—Greenblum & Bernstein, P.L.C.

(57) ABSTRACT

Paper sizing compositions comprising (a) cellulose-reactive size, (b) dispersant system comprising primary anionic dispersant, and secondary dispersant selected from cationic and/or non-ionic dispersant, and (c) inorganic salt.

72 Claims, No Drawings

PAPER SIZING COMPOSITION

BACKGROUND OF THE INVENTION

1. Field of the Invention

This invention relates to paper sizing compositions containing a) sizing agent, b) dispersant system, and c) inorganic salt, and also to methods of sizing paper using such compositions, and to products made using such sizing compositions.

2. Background of the Invention

Cellulose-reactive sizing agents, such as alkyl ketene dimers (AKDs), are widely used in the paper making industry as components in sizing dispersion formulations. The usefulness of such agents derives from their ability to bond directly to the hydroxyl groups on the cellulose component of the paper. Frequently, in these sizing formulations, the sizes, e.g., AKDs, are combined with dispersant systems which include cationic starch and/or sodium lignosulfonate. Examples of such dispersions can be found in U.S. Pat. No. 4,861,376, to Edwards, and U.S. Pat. No. 3,223,544, to Savina, the disclosures of which are hereby incorporated by reference.

The usefulness of inorganic salts such as alum, or aluminum containing salts, in paper making processes has also been known for some time. Practically, these salts greatly improve machine productivity by enhancing dewatering. As a general rule, the higher the concentration of the salts, the better the dewatering capacity.

The combination of organic sizing agents such as AKD dispersions and inorganic salts such as alum is thus a valuable combination, providing both sizing and dewatering capacity. Examples of such combinations are presented in U.S. Pat. No. 5,145,522 to Nakagawa et al. and U.S. Pat. No. 5,627,224, to Lyrmalm et al., the disclosures of which are hereby incorporated by reference. The problem encountered by this combination, however, is that organic sizing agents tend to be quite incompatible with inorganic salts, separating out if the concentration of the inorganic salts becomes too high in a liquid phase of the organic sizing dispersion.

There is, therefore, a need in the art for a dispersant system which is compatible with inorganic salts and organic sizing agents. A number of dispersant systems have been described in the literature. For example, in U.S. Pat. No. 5,627,224, an amphoteric polymer is used as the sole dispersant to incorporate polyaluminum compounds in dispersions of AKD. However, achieving good stability in compositions containing organic sizes and inorganic salts has been elusive. Thus, there is a need in the art for compositions which solve the aforementioned problems.

SUMMARY OF THE INVENTION

In view of the foregoing, it is an object of the present invention to provide sizing dispersions with improved stability.

It is a further object of the present invention to provide sizing dispersions which enhance dewatering capacity.

It is a further object of the present invention to provide sizing dispersions which comprise organic sizing agent, and inorganic salt in varying concentrations, including high inorganic salt concentrations.

The present invention is also directed to compositions comprising (a) cellulose-reactive size, (b) dispersant system comprising primary dispersant and secondary dispersant, and (c) inorganic salt, to methods of producing and using said compositions, as well as products including the composition.

The present invention is achieved by the provision of an aqueous composition comprising cellulose-reactive size, dispersant system comprising anionic dispersant and at least one cationic dispersant or non-ionic dispersant; and at least one salt comprising an element in an amount equivalent to, or greater than, about 5.5 wt % aluminum, based on the weight of cellulose-reactive size. In preferred embodiments, the cellulose-reactive size comprises at least one of ketene dimer and ketene multimer; more preferably the ketene dimer comprises at least one of alkenyl ketene dimer and alkyl ketene dimer. In other preferred embodiments, the cellulose-reactive size comprises at least one of alkenyl succinic anhydride and stearic anhydride.

The cellulose-reactive size may comprise organic epoxide containing from about 12 to about 22 carbon atoms, acyl halide containing from about 12 to about 22 carbon atoms, fatty acid anhydride from fatty acid containing from about 12 to about 22 carbon atoms, or organic isocyanate containing from about 12 to about 22 carbon atoms.

Preferably, the composition comprises a ketene dimer or ketene multimer of Formula

I

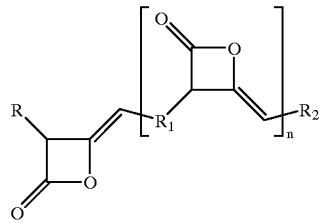

where n is an integer of from 0 to about 20, R and $R_2$ are the same or different and are saturated or unsaturated hydrocarbyl groups having from about 6 to about 24 carbon atoms, and $R_1$ is a saturated or unsaturated hydrocarbyl group having from about 2 to about 40 carbon atoms. Preferably, n has a value of from 0 to about 6; more preferably, n is from 0 to about 3; and most preferably, wherein n is 0. R may be a saturated or unsaturated hydrocarbyl group having from about 10 to 20 carbon atoms; preferably, R is a saturated or unsaturated hydrocarbyl group having from about 14 to 16 carbon atoms. $R_2$ is preferably a saturated or unsaturated hydrocarbyl group having from about 10 to 20 carbon atoms; more preferably, $R_2$ is a saturated or unsaturated hydrocarbyl group having from about 14 to 16 carbon atoms. Preferably, $R_1$ is a saturated or unsaturated hydrocarbyl group having from about 4 to 20 carbon atoms.

The anionic dispersant may comprise polymeric dispersant containing sulfate or sulfonate. Such anionic dispersants include formaldehyde condensate of sodium naphthalene sulfonate, formaldehyde condensate of sodium alkylnaphthalene sulfonate, formaldehyde condensate of sodium phenol sulfonate, formaldehyde condensate of sodium phenol sulfate, and lignosulfonate, which preferably comprises sodium lignosulfonate. Preferably, the sodium lignosulfonate comprises sodium lignosulfonate having less than about 5.9 wt %, more preferably less than about 5 wt %, more preferably less than about 4.5 wt %, more preferably less than about 4 wt %, and most preferably less than about 3.6 wt % sulfonate sulfur based on the total weight of the sodium lignosulfonate.

The anionic dispersant may be present in an amount of from about 0.02 to about 20 wt %, more preferably from about 0.4 to about 7 wt %, and most preferably from about 0.9 to about 3 wt % of the weight of the cellulose-reactive size.

Preferred compositions comprise cationic dispersant, which is preferably cationically modified starch, cationically modified guar, or low charge cationic polymer. Preferably, the composition comprises cationically modified starch in an amount of from about 0.4 to about 400 wt %, more preferably from about 2 to about 100 wt %, and most preferably from about 10 to about 30 wt % of the weight of the cellulose-reactive size.

The salt may comprise a metal selected from Groups I, II, III, IV, V, and Transition Elements of the Periodic Table, and combinations thereof. Preferably, the salt comprises aluminum, magnesium calcium, or barium. Preferably, the composition comprises aluminum salt of the formula $Al_x(SO_4)_y(H_2O)_z$, wherein x is 1 to 3, y is 1 to 4, and z is 0 to 20. Preferably, the aluminum salt is aluminum sulfate. The aluminum salt may also have the formula $Al_n(OH)_mX_{3n-m}$, wherein X is a negative ion, n and m are integers greater than 0, and 3n−m is greater than 0. In such salts, the negative ion preferably comprises chloride or acetate, and the aluminum salt comprises polyaluminum chloride.

In on aspect of the invention, the salt may be present in an amount equivalent to from about 5.5 wt % aluminum to about 10 wt % aluminum, based on the weight of cellulose-reactive size; more preferably the salt is present in an amount equivalent to from about 6 wt % aluminum to about 8 wt % aluminum, based on the weight of cellulose-reactive size.

The present invention is further achieved by the provision of an aqueous composition comprising cellulose-reactive size, dispersant system comprising modified sodium lignosulfonate and at least one of cationic dispersant, non-ionic dispersant, and combinations thereof, and at least one salt comprising an element in an amount equivalent to, or greater than, about 0.2 wt % aluminum, based on the weight of cellulose-reactive size. In such compositions, the salt may be present in an amount equivalent to, or greater than, about 0.4 wt % aluminum, based on the weight of cellulose-reactive size. Preferably, the salt is present in an amount equivalent to, or greater than, about 1.5 wt %, more preferably equivalent to, or greater than, about 3 wt %, more preferably equivalent to, or greater than, about 4.4 wt %, more preferably equivalent to, or greater than, about 5.5 wt %, and most preferably equivalent to, or greater than, about 6 wt % aluminum, based on the weight of cellulose-reactive size.

The composition may comprise salt in an amount equivalent to, or less than, about 40 wt %, more preferably, equivalent to, or less than, about 30 wt %, more preferably equivalent to, or less than, about 20 wt %, more preferably equivalent to, or less than, about 15 wt %, more preferably equivalent to, or less than, about 12 wt %, more preferably equivalent to, or less than, about 10 wt %, and most preferably equivalent to, or less than, about 8 wt % aluminum, based on the weight of cellulose-reactive size.

The composition may comprise salt in an amount equivalent to from about 0.2 wt % to about 40 wt %, more preferably from about 0.4 wt % to about 30 wt %, more preferably from about 1.5 wt % to about 20 wt %, more preferably from about 3 wt % to about 15 wt %, more preferably from about 4.4 wt % to about 12 wt %, more preferably from about 5.5 wt % to about 10 wt %, and most preferably from about 6 wt % to about 8 wt % aluminum, based on the weight of cellulose-reactive size.

The present invention is still further achieved by the provision of an aqueous composition comprising at least one of ketene dimer and ketene multimer, dispersant system comprising modified sodium lignosulfonate and cationically modified starch, and aluminum sulfate.

The present invention is also achieved by an aqueous composition for sizing a paper product, produced by combining cellulose-reactive size, dispersant system comprising anionic dispersant and at least one of cationic dispersant and non-ionic dispersant, and at least one salt comprising an element in an amount greater than, or equivalent to, 5.5 wt % aluminum, based on the weight of cellulose-reactive size.

The present invention is further achieved by a method for sizing a cellulose-based product, comprising adding cellulose-reactive size, dispersant system comprising anionic dispersant and at least one of cationic dispersant and non-ionic dispersant, and at least one salt comprising an element in an amount greater than, or equivalent to, 5.5 wt % aluminum, based on the weight of cellulose-reactive size, to cellulosic material. In preferred embodiments, the cellulosic material may comprise pulp or the surface of a paper product.

The present invention is also achieved by a the provision of a kit comprising for sizing a cellulose-based product, the kit comprising cellulose-reactive size, dispersant system comprising anionic dispersant and at least one of cationic dispersant and non-ionic dispersant, and at least one salt comprising an element in an amount greater than, or equivalent to, 5.5 wt % aluminum, based on the weight of cellulose-reactive size.

DETAILED DESCRIPTION OF THE INVENTION

This invention provides paper sizing compositions containing inorganic salt, dispersant system, and cellulose-reactive sizing agent, such as ketene dimer. The sizing compositions of the present invention are stable, even under the environment of high concentration of inorganic salts. The sizing compositions, including the inorganic salts, together with the dispersants, promote action of the reactive sizing agents and provide improved dewatering efficiency during paper making.

Unless otherwise indicated, all percentages, parts, ratios, etc. stated herein are by weight. Moreover, all percent values in this application, unless otherwise stated, are calculated by weight based upon 100% of a given sample weight. Thus, for example, 30% represents 30 weight parts out of every 100 weight parts of the sample.

Unless otherwise stated, a reference to a compound or component, includes the compound or component by itself, as well as in combination with other compounds or components, such as mixtures of compounds. For example, as used herein, the term cellulose-reactive size is meant to include cellulose-reactive sizes, alone and/or combinations of cellulose-reactive sizes, and the term inorganic salt is meant to include inorganic salts, alone and/or combinations of inorganic salts.

As used herein, the term "hydrocarbyl" is understood to include "aliphatic," "cycloaliphatic," and "aromatic." The hydrocarbyl groups are understood to include alkyl, alkenyl, alkynyl, cycloalkyl, aryl, aralkyl, and alkaryl groups. Further, "hydrocarbyl" is understood to include both non-substituted hydrocarbyl groups, and substituted hydrocarbyl groups, with the latter referring to the hydrocarbon portion bearing additional substituents, besides carbon and hydrogen.

As used herein, the term "stable" means the claimed composition meets at least three criteria: 1) the composition does not gel for an aging period of at least two weeks; 2) the aqueous composition maintains a viscosity less than 5,000 centipoise for an aging period of at least two weeks; and 3)

the aqueous composition does not separate into separate phases during an aging period of at least two weeks. Each criterion is described below.

The first criterion is the absence of gelling. As used herein, gel or gelling means the composition exhibits solid-like behavior under the action of mechanical force. Gelling should be tested as follows: immediately after making the composition, two samples are placed in 100-gram bottles. The first bottle is tested immediately for gelling. A simple test for gelling is done by observing the sample while slowly tilting to 15°. If the sample does not flow, it is considered gelled. The second bottle is tested for gelling after storage for two weeks at 32° C. Gelling is measured at room temperature.

The second criterion is viscosity. Preferably, the viscosity of the sample is less than 5,000, more preferably less than 4,000, even more preferably less than 3,000, even more preferably less than 1,000, even more preferably less than 500, even more preferably less than 300, and most preferably less than 200 centipoises. Viscosity is determined by using a Brookfield DV-II viscometer. The choice of spindle and speed (RPM) is readily determined by one of skill in the art. Viscosity should be tested as follows: immediately after making the composition, two 100-gram samples are placed in 100-gram bottles. The first bottle is tested immediately for its viscosity. The second bottle is tested for its viscosity after storage for two weeks at 32° C. Prior to testing, each sample bottle should be allowed to come to room temperature.

The third criterion is separation, which is measured as the total bottom solid of the aqueous composition. The bottom total solid (BTS %) should not change more than 20% within two weeks at 25° C. aging. More preferably, the bottom total solid does not change more than 15%, more preferably not more than 10%, and most preferably not more than 5%.

Bottom total solid should be tested as follows: immediately after making the composition, two 100-gram samples are placed in 100-gram bottles. The first bottle is tested immediately for its bottom total solid. The second bottle is tested for its bottom total solid after it is aged for two weeks at 25° C. Bottom total solid is determined by sampling, with a pipette, an amount from the "bottom" of each sample. This sampling is preferably performed by touching the pipette to the bottom of a 100 g bottle of sample and withdrawing about 2 g of sample. From this about 2 g of sample, 1.5 g is placed on an aluminum weighing dish. This 1.5 g pipetted sample is heated in a 150° C. oven for about 45 minutes. The percentage of the non-volatile content in the dispersion is determined by measuring the remaining mass after drying. The remaining percent of a sample obtained from the bottom of a 100 g glass bottle of sample is called the "bottom total solid" BTS %. The percent change during aging is calculated by comparing the total bottom solids from the aged sample to the total bottom solids from the non-aged sample.

In the foregoing descriptions of stability criteria, the two-week aging period is considered preferable. More preferably, the criteria are still satisfied after at least one month, and more preferably, the criteria are still satisfied after three months. Most preferably, the compositions satisfy the stability criteria after six months.

Compositions of the present invention comprise (a) cellulose-reactive size, (b) dispersant system comprising primary anionic dispersant, and a secondary dispersant comprising at least one member selected from cationic or non-ionic dispersant, and (c) inorganic salt. Details of components (a), (b), and (c) are addressed hereinafter.

Cellulose-Reactive Size

Cellulose-reactive size suitable for use in the present invention preferably includes sizes believed to be capable of forming covalent chemical bonds by reaction with the hydroxyl groups of cellulose. Cellulose-reactive sizes suitable for use in the present invention, which are preferably hydrophobic, may function in the final product as water-repellants.

Preferable cellulose-reactive sizes include, but are not limited to, ketene dimers and multimers such as alkyl ketene dimer (AKD) and alkenyl ketene dimer; alkenyl succinic anhydride (ASA); stearic anhydride; organic epoxides containing from about 12 to about 22 carbon atoms; acyl halides containing from about 12 to about 22 carbon atoms; fatty acid anhydrides from fatty acids containing from about 12 to about 22 carbon atoms; and organic isocyanates containing from about 12 to about 22 carbon atoms.

Ketene dimers and multimers used in accordance with this invention preferably have the Formula I:

I

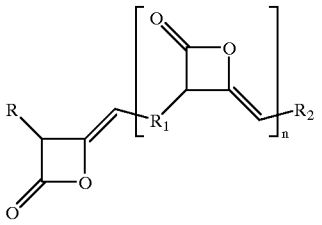

where n is an integer of from 0 to 20 or more, preferably from 0 to 6, more preferably from 0 to 3 and most preferably 0. R and $R_2$, which may be the same or different, are saturated or unsaturated hydrocarbyl groups having from about 6 to about 24 carbon atoms, preferably about 10 to about 20 carbon atoms, and more preferably about 14 to about 16 carbon atoms. $R_1$ is a saturated or unsaturated hydrocarbyl group having from about 2 to about 40 carbon atoms, preferably about 4 to about 20 carbon atoms. Preferably at least about 25% of the R and $R_2$ groups are unsaturated.

Preferably, ketene dimer comprises (a) octyl, decyl, dodecyl, tetradecyl, hexadecyl, octadecyl, eicosyl, docosyl, tetracosyl, phenyl, benzyl, β-naphthyl, and cyclohexyl ketene dimers, and/or (b) ketene dimers prepared from organic acids such as one or more of montanic acid, mapgthenic acid, 9, 10-decylenic acid, 9, 10-dodecylenic acid, palmitoleic acid, oleic acid, ricinoleic acid, linoleic acid, eleostearic acid, naturally occurring mixtures of fatty acids found in coconut oil, babassu oil, palm kernel oil, palm oil, olive oil, peanut oil, rape oil, beef tallow, lard, whale blubber, and mixtures of any of the above named fatty acids. Most preferably ketene dimer is selected from the group consisting of octyl, decyl, dodecyl, tetradecyl, hexadecyl, octadecyl, eicosyl, docosyl, tetracosyl, phenyl, benzyl, β-naphthyl, and cyclohexyl ketene dimers.

Alkyl ketene dimers have been used commercially for many years and are prepared by dimerization of the alkyl ketenes made from saturated, straight chain fatty acid chlorides; the most widely used are prepared from palmitic and/or stearic acid. Aqueous dispersions of these materials are available as Hercon® paper sizing agents from Hercules Incorporated, Wilmington, Del.

Ketene multimers for use in the process of this invention have the Formula I above where n is an integer of at least 1, R and $R_2$, which may be the same or different, are saturated or unsaturated straight chain or branched alkyl groups having 6 to 24 carbon atoms, preferably 10 to 20 carbon atoms, and more preferably 14 to 16 carbon atoms; and $R_1$ is a saturated or unsaturated straight chain or branched alkylene group having from 2 to 40 carbon atoms, preferably from 4 to 8 or from 28 to 40 carbon atoms.

Ketene multimers are described in: European Patent Application Publication No. 0,629,741 A1, U.S. Pat. No. 5,685,815, and in PCT International Publication No. WO 97/30218, each of which is incorporated herein by reference in its entirety.

Ketene dimers and multimers for use in the invention include those which are solid, or are not solid at 25° C. (not substantially crystalline, semi-crystalline or waxy solid; i.e., they flow on heating without heat of fusion).

Ketene dimers and multimers may be mixtures of compounds of Formula I above in which n is preferably 0 to 6, more preferably 0 to 3, and most preferably 0; R and $R_2$, which can be the same or different, are saturated or unsaturated, straight chain or branched alkyl groups having 6 to 24 carbon atoms; $R_1$ is a saturated or unsaturated, straight chain or branched alkylene group having 2 to 40 carbon atoms, preferably 4 to 32 carbon atoms; and wherein at least 25% of the R and $R_2$ groups in the mixture of compounds are unsaturated.

The ketene dimers and multimers may comprise a mixture of ketene dimer or multimer compounds that are the reaction product of a reaction mixture comprising unsaturated monocarboxylic fatty acids. The reaction mixture may further comprise saturated monocarboxylic fatty acids and dicarboxylic acids. Preferably the reaction mixture for preparing the mixture of dimer or multimer compounds comprises at least 25 wt % unsaturated monocarboxylic fatty acids, and more preferably at least 70 wt % unsaturated monocarboxylic fatty acids.

The unsaturated monocarboxylic fatty acids included in the reaction mixture preferably have 10–26 carbon atoms, more preferably 14–22 carbon atoms, and most preferably 16–18 carbon atoms. These acids include, for example, oleic, linoleic, dodecenoic, tetradecenoic (myristoleic), hexadecenoic (palmitoleic), octadecadienoic (linolelaidic), octadecatrienoic (linolenic), eicosenoic (gadoleic), eicosatetraenoic (arachidonic), cis-13-docosenoic (erucic), trans-13-docosenoic (brassidic), and docosapentaenoic (clupanodonic) acids, and their acid halides, preferably chlorides. One or more of the monocarboxylic acids may be used. Preferred unsaturated monocarboxylic fatty acids are oleic, linoleic, linolenic and palmitoleic acids, and their acid halides. Most preferred unsaturated monocarboxylic fatty acids are oleic and linoleic acids, and their acid halides.

The saturated monocarboxylic fatty acids used to prepare the ketene dimer and multimer compounds used in this invention preferably have 10–26 carbon atoms, more preferably 14–22 carbon atoms, and most preferably 16–18 carbon atoms. These acids include, for example, stearic, isostearic, myristic, palmitic, margaric, pentadecanoic, decanoic, undecanoic, dodecanoic, tridecanoic, nonadecanoic, arachidic and behenic acids, and their halides, preferably chlorides. One or more of the saturated monocarboxylic fatty acids may be used. Preferred acids are palmitic and stearic.

The alkyl dicarboxylic acids used to prepare the ketene multimer compounds for use in this invention preferably have 6–44 carbon atoms, and more preferably 9–10, 22, or 36 carbon atoms. Such dicarboxylic acids include, for example, sebacic, azelaic, 1, 10-dodecanedioic, suberic, brazylic, docosanedioic acids, and $C_{36}$ dimer acids, e.g. EMPOL 1008 available from Henkel-Emery, Cincinnati, Ohio, and their halides, preferably chlorides. One or more of these dicarboxylic acids can be used. Dicarboxylic acids with 9–10 carbon atoms are more preferred. The most preferred dicarboxylic acids are sebacic and azelaic acids.

When dicarboxylic acids are used in the preparation of the ketene multimers for use in this invention, the maximum mole ratio of dicarboxylic acid to monocarboxylic acid (the sum of both saturated and unsaturated) is preferably about 5. A more preferred maximum is about 4, and the most preferred maximum is about 2. The mixture of dimer and multimer compounds may be prepared using methods known for the preparation of standard ketene dimers. In the first step, acid halides, preferably, acid chlorides, are formed from a mixture of fatty acids, or a mixture of fatty acids and dicarboxylic acid, using $PCl_3$ or another halogenating, preferably chlorinating, agent. The acid halides are then converted to ketenes in the presence of tertiary amines (including trialkyl amines and cyclic alkyl amines), preferably triethylamine. The ketene moieties then dimerize to form the desired compounds.

Ketene dimers and multimers are disclosed in U.S. Pat. No. 5,685,815, and in PCT International Publication No. WO 97/30218, each of which is incorporated herein by reference in its entirety. Ketene dimers are available as Precis® sizing agents, also from Hercules Incorporated.

Alkenylsuccinic anhydrides (ASA) in accordance with the present invention are preferably composed of unsaturated hydrocarbon chains containing pendant succinic anhydride groups. They are usually made in a two-step process starting with alpha olefin. The olefin is first isomerized by randomly moving the double bond from the alpha position. In the second step the isomerized olefin is reacted with maleic anhydride to give the final ASA having the Formula II:

II

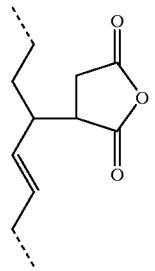

Typical olefins used for the reaction with maleic anhydride include alkenyl, cycloalkenyl and aralkenyl compounds containing from about 8 to about 22 carbon atoms. Specific examples are isooctadecenyl succinic anhydride, n-octadecenyl succinic anhydride, n-hexadecenyl succinic anhydride, n-dodecyl succinic anhydride, i-dodecenyl succinic anhydride, n-decenyl succinic anhydride and n-octenyl succinic anhydride.

Alkenylsuccinic anhydrides are disclosed in U.S. Pat. No. 4,040,900, which is incorporated herein by reference in its entirety, and by C. E. Farley and R. B. Wasser in *The Sizing of Paper*, Second Edition, edited by W. F. Reynolds, Tappi Press, 1989, pages 51–62. A variety of alkenylsuccinic anhydrides is commercially available from Albemarle Corporation, Baton Rouge, La. Alkenylsuccinic anhydrides for use in the invention are preferably liquid at 25° C. More preferably they are liquid at 20° C.

The amount of cellulose-reactive size is preferably an amount sufficient to provide a sizing effect to the composition. On the lower end, the amount of cellulose-reactive size in the composition is preferably greater than about 1 wt % of the weight of the aqueous composition, more preferably greater than about 5 wt % of the weight of the aqueous composition, and most preferably greater than about 7 wt % of the weight of the aqueous composition. On the upper end, the amount of cellulose reactive size is preferably less than about 50 wt % of the weight of the aqueous composition, more preferably less than 30 wt % of the weight of the aqueous composition, and most preferably less than 15 wt % of the weight of the aqueous composition. Expressed as a range, the amount of cellulose-reactive size in the composition is preferably from about 1 to about 50 wt % of the weight of the aqueous composition, more preferably from about 5 to about 30 wt % of the weight of the aqueous composition, and most preferably from about 7 to about 15 wt % of the weight of the aqueous composition.

Dispersant System

The composition further comprises a dispersant system, preferably serving the purpose of making the composition stable. The dispersant system comprises a primary and secondary dispersant. The terms "primary" and "secondary" are used herein for ease of reference and are not to be considered limiting in any way. The primary dispersant comprises at least one anionic dispersant. Suitable anionic dispersants include, but are not limited to, polymeric dispersants containing sulfonate and sulfate as their functional groups. Examples of such anionic dispersants include, but are not limited to, formaldehyde condensates of sodium naphthalene sulfonate, formaldehyde condensates of sodium alkylnaphthalene sulfonate, formaldehyde condensates of sodium phenol sulfonate, formaldehyde condensates of sodium phenol sulfate, and lignosulfonates including sodium lignosulfonate and modified sodium lignosulfonate.

Especially preferred anionic dispersants are those which provide stability to the composition, even in the presence of high amounts of inorganic salt. Preferably, the anionic dispersant comprises at least one lignosulfonate. Preferably the lignosulfonate comprises a lignosulfonate which exhibits a hydrophobicity which is increased relative to normal lignosulfonates, such as Norlig 12F® (Lignotech, USA Inc., Wisconsin), and therefore have a hydrophile-lipophile balance (HLB) which is shifted toward a more hydrophobic value as compared to unmodified lignosulfonates. Thus, preferred lignosulfonates are hydrophobic lignosulfonates. An increase in the hydrophobicity of lignosulfonates can be achieved in a number of manners, but is preferably achieved by decreasing the weight percent of sulfonate sulfur in the lignosulfonate. A general description of methods for modifying lignosulfonates, and in particular, for decreasing sulfonate sulfur concentration, is described in "A Working Chemist's Guide to the Chemisitry of Lignosulphonates," pages 1–12, Reed Inc., Chemical Division (Quebec, Canada), the entire contents of which is hereby incorporated by reference.

Preferred lignosulfates are sodium lignosulfonates which comprise less than about 5.9 wt %, more preferably less than about 5 wt %, even more preferably less than 4.5 wt %, even more preferably less than about 4 wt %, and most preferably about 3.6 wt % sulfonate sulfur based on the total weight of the sodium lignosulfonate. Preferably, the sodium lignosulfates comprise greater than about 0.5 wt %, more preferably greater than about 1.5 wt %, and most preferably greater than about 2.5 wt % sulfonate sulfur based on the total weight of the sodium lignosulfonate. Preferred sodium lignosulfonates comprise from about 0.5 wt % to about 5.9 wt %, more preferably from about 1.5 wt % to about 5 wt %, and most preferably from about 2.5 wt % to about 4 wt % sulfonate sulfur based on the total weight of the sodium lignosulfonate.

The molecular weights of suitable sodium lignosulfonates are preferably greater than about 2,000 grams/mole, more preferably greater than about 5,000 grams/mole, and most preferably greater than about 10,000 grams/mole. Suitable sodium lignosulfates preferably have molecular weights less than about 150,000 grams/mole, more preferably less than 120,000 grams/mole, and most preferably less than 80,000 grams/mole. Preferred sodium lignosulfates range in molecular weight of from about 2,000 grams/mole to about 150,000 grams/mole, more preferably from about 5,000 grams/mole to about 120,000 grams/mole, and most preferably from about 10,000 grams/mole to about 80,000 grams/mole.

Preferably, the anionic dispersants are used in an amount of greater than about 0.01 wt %, more preferably greater than about 0.05 wt %, and most preferably greater than about 0.1 wt % of the weight of the aqueous composition. Preferably, the anionic dispersants are used in amounts less than about 10 wt %, more preferably less than 5 wt %, and most preferably less than 3 wt % of the weight of the aqueous composition. Preferably, the amount of anionic dispersant ranges from about 0.01 to about 10 wt %, more preferably from about 0.05 to about 5 wt %, and most preferably from about 0.1 wt % to about 3 wt % of the weight of the aqueous composition.

The amount of anionic dispersant may be expressed as a percentage of the weight of cellulose-reactive size. Preferably, the anionic dispersant is from about 0.02 to about 20 wt % of the weight of the sizing agent, more preferably from about 0.40 to about 7 wt % of the weight of the cellulose-reactive size, and most preferably from about 0.90 to about 3 wt % of the weight of the cellulose-reactive size.

An example of a suitable sodium lignosulfonate with a high hydrophobicity is Dynasperse LCD® (Lignotech USA, Inc., Wisconsin), and an example of a sodium lignosulfonate is Norlig 12F® (Lignotech, USA Inc., Wisconsin).

The dispersant system further comprises a secondary dispersant, which may act as a stabilizing agent. The secondary dispersant suitably comprises dispersant which is not an anionic dispersant, i.e., which is a cationic and/or a non-ionic dispersant. Cationic dispersants are those dispersants which have a net cationic charge. Cationic dispersants include, but are not limited to, cationically modified starches and guars or low charge cationic polymers. Low charge cationic polymers include those polymers that preferably have less than 51% of the repeating units in the polymer carrying cationic charge while the rest of the repeating units carry either no charge or anionic charge, provided that the net charge on the polymer is a cationic charge. Examples of low charge cationic polymers include Kymene® 557H, LX, SLX, and ULX (Hercules Incorporated, Wilmington, Del.), which are polyaminopolyamide-epichlorohydrin resins, and Merquat 550 (Calgon Corporation, Pittsburgh, Pa.). Polyaminopolyamide-epichlorohydrin resins are described in U.S. Pat. No. 5,470,742, to Bull et al., U.S. Pat. No. 5,714,552, to Bower, U.S. Pat. No. 5,171,795, to Miller et al., and U.S. Pat. No. 5,614,597, to Bower, the entire contents of each of which is hereby incorporated by reference. The use of cationic polymers in sizing compositions is generally described in U.S. Pat. Nos. 4,243,481, 4,240,935, 4,279,794, 4,295,931, 4,317,756, and 4,522,686, all to Dumas, the entire contents of each of which is hereby incorporated by reference. Non-ionic dispersants include, but are not limited to, any water soluble non-ionic polymers such as starches and polyethylene oxides. The secondary dispersant preferably comprises cationically modified starch.

Secondary dispersant is preferably used in an amount of greater than about 0.2 wt %, more preferably greater than about 0.5 wt %, and most preferably greater than about 1 wt %. Preferably, the secondary dispersant is used in an amount less than 20 wt %, more preferably less than 5 wt %, and most preferably less than 3.5 wt %. Preferably, the amount of secondary dispersant ranges from about 0.2 to about 20 wt %, more preferably from about 0.5 to about 5 wt %, and most preferably from about 1 wt % to about 3.5 wt %, based on the weight of the aqueous composition.

The amount of secondary dispersant may be expressed as a percentage of the weight of cellulose-reactive size used. Preferably, the secondary dispersant is from about 0.4 to about 400 wt % of the weight of the cellulose-reactive size, more preferably from about 2 to about 100 wt % of the weight of the cellulose-reactive size, and most preferably from about 10 to about 30 wt % of the weight of the cellulose-reactive size.

Preferred secondary dispersants comprise starches which include, but are not limited to, any water soluble cationic starches. Preferred starches include cationic waxy maize starches with either tertiary or quaternary amino groups as the source of the charge. The preferred viscosity range of the starch is from low to moderate.

The viscosity of the starch solution can be obtained by cooking the starch in water at 95° C. for 30 minutes at pH of 4.5–6. As used herein, moderate viscosity means a Brookfield viscosity of from about 101 to about 2000 centistokes measured with a #2 spindle at 100 rpm and 38° C. using a 10% by weight starch solution. As used herein, low viscosity means a Brookfield viscosity of from about 1 to 100 centistokes measured with a #2 spindle at 100 rpm and 38° C. using a 10% by weight starch solution. An example of a preferred starch is Sta lok® 140 made by A. E. Staley Manufacturing Company, Illinois.

Inorganic Salt

Compositions of the present invention comprise a salt, which is preferably an inorganic salt. Preferably, the salt is a compound that improves dewatering. Preferred inorganic salts perform this function, although the inorganic salt may perform other functions in the composition as well. For example, the inorganic salt(s) may also act to improve retention of the sizing agents.

Preferably, the inorganic salt comprises a metal salt, which may be an alkaline earth metal (Group II of the Periodic Table) salt, an alkali metal (Group I of the Periodic Table) salt, or a salt formed from the transition metals (of the Periodic Table), or from the metals of Group III, IV, and V (of the Periodic Table). Any number of salts are useful in this regard, including salts of magnesium, barium, aluminum, and calcium, but are preferably selected from aluminum salts and calcium salts. Suitable aluminum salts include, but are not limited to, aluminum sulfate with the formula of $Al_x(SO_4)_y(H_2O)_z$, where x is 1 to 3, y is 1 to 4 and z is 0 to 20. A suitable aluminum sulfate called Alum is commercially available (General Chemical Corporation, New Jersey). Other aluminum salts include polyaluminum compounds with the formula of $Al_n(OH)_mX_{3n-m}$, wherein X is a negative ion such as chloride or acetate, and n and m are integers greater than zero, such that (3n−m) is greater than zero. When X is chloride, the salt is polyaluminum chloride (PAC). Calcium salts suitable for use in the present invention preferably have the formula of $CaY_n$, where Y is a negative ion such as chloride, acetate, or nitrate, and n is 1 to 2. A mixture of salts may also be used.

When aluminum salt is used, the amount is preferably from about 0.02 to about 2 wt % of aluminum element, more preferably from about 0.04 wt % to about 1.5 wt %, and most preferably from about 0.08 wt % to about 0.8 wt % of aluminum element based on the weight of the aqueous composition. When calcium salt is used, the amount is preferably from about 0.04 wt % to about 4.4 wt % of calcium element, more preferably from about 0.1 wt % to about 3.3 wt % of calcium element, and most preferably from about 0.2 wt % to about 2 wt % of calcium element, based on the weight of the aqueous composition.

The amount of aluminum element, when present, may be expressed as a percentage of the weight of cellulose-reactive size used. Preferably, the aluminum element is present in an amount greater than about 0.2 wt %, more preferably greater than about 0.4 wt %, more preferably greater than about 1.5 wt %, more preferably greater than about 3 wt %, more preferably greater than about 4.4 wt %, more preferably greater than about 5.5 wt %, and most preferably greater than about 6 wt % of the weight of the cellulose-reactive size. Preferably, the aluminum element is present in an amount less than about 40 wt %, more preferably less than about 30 wt %, more preferably less than about 20 wt %, more preferably less than about 15 wt %, more preferably less than about 12 wt %, more preferably less than about 10 wt %, and most preferably less than about 8 wt % of the weight of the cellulose-reactive size. Expressed as a range, the aluminum element is preferably present in an amount of from about 0.2 wt % to about 40 wt %, more preferably from about 0.4 to about 30 wt %, more preferably from about 1.5 to about 20 wt %, more preferably from about 3 to about 15 wt %, more preferably from about 4.4 to about 12 wt %, more preferably from about 5.5 to about 10 wt %, and most preferably from about 6 to about 8 wt % of the weight of the cellulose-reactive size.

The amount of metal salts to be used in accordance with the present invention may be determined by their equivalence to aluminum. For purposes of this disclosure, equivalence to aluminum is determined by calculating the atomic mass to charge ratio of the metal element(s) in the salt. For example, aluminum has an atomic mass of 27 and a charge of $3^+$, which converts to an atomic mass to charge ratio of 9 (27/3). Calcium has an atomic mass of 40 and a charge of $2^+$, and thus has an atomic mass to charge ratio of 20. To determine calcium's equivalence to aluminum, the atomic mass to charge ratio of calcium, 20, is divided by the atomic mass to charge ratio of aluminum, 9, which results in 2.2. The resulting number, 2.2, is the multiplier to determine the weight of calcium equivalent to the weight of aluminum. Thus, if one gram of aluminum is required, 2.2 grams of calcium will be equivalent. As other examples, the multiplier for magnesium (24/2=12) is 1.3 (12/9); sodium (23/1=23) is 2.6 (23/9); beryllium (9/2=4.5) is 0.50 (4.5/9); and lithium (6.9/1=6.9) is 0.77 (6.9/9). These conversions are applicable to any metal. By using this equivalence formula, one can combine any number of different inorganic salts to achieve the desired effect.

As an example, consider Example 1 below: 445.6 g of a 48.5% solution of alum (aluminum sulfate, $Al_2(SO_4)_3 \cdot 14H_2O$, MW 594) is added to a sample having 222.8 g of AKD (a cellulose-reactive size). This amount of alum comprises 19.6 grams of aluminum (445.6×0.485=216.116; 216.116 g aluminum sulfate×54 g aluminum/594 g aluminum sulfate=19.6 g aluminum). Using the conversion shown above, this amount of aluminum is equivalent to 43.2 grams calcium (19.6×2.2), 25.5 grams magnesium (19.6×1.3), 9.8 grams beryllium (19.6×0.5), and 15.1 grams lithium (19.6×0.77). Thus, one could easily substitute one inorganic salt for another, or combine different salts, with little difficulty.

Additionally, in calculating equivalence, the non-metal part of the salt should not be considered. For example, in aluminum sulfate, the atomic mass to charge ratio of sulfate is not considered.

Therefore, as used herein, an amount of an element which is "equivalent" to an amount of aluminum is that amount which is equivalent using the foregoing conversions. For example, an amount of calcium, magnesium, or barium, which is equivalent to X wt % aluminum is determined using the foregoing conversions. Briefly, this would entail determining the number of grams of aluminum in X wt % aluminum. From the number of grams of aluminum, a simple conversion is performed to determine an amount of calcium, magnesium, or barium equivalent to X wt % aluminum.

And, of course, an amount of aluminum which is equivalent to an amount of aluminum is the same amount. Thus, "an amount of aluminum which is equivalent to 6 wt % aluminum" is 6 wt % aluminum. This apparently obvious fact is presented here as a matter of clarity.

This simple manner of converting also applies to amounts which relate to an amount of aluminum. For example, as used herein, an amount of an element which is "greater than," or "less than," an amount of aluminum is that amount which is greater than, or less than, using the foregoing conversions. For example, an amount of calcium, magnesium, or barium, which is greater than X wt % aluminum is determined using the foregoing conversions. Briefly, this would entail determining the number of grams of aluminum in X wt % aluminum. From the number of grams of aluminum, a simple conversion is performed to determine an amount of calcium, magnesium, or barium greater than X wt % aluminum.

Other ingredients common to papermaking art such as biocides, clay, calcium carbonate, titanium dioxide, nonionic surfactants, optical brighteners, retention and drainage aids, etc. may be used in their normal ranges and are found or expected to be compatible with the compositions described above. Water is used to make the total composition to 100 percent.

This invention may be used in internal sizing in which the sizing dispersions are added to the pulp slurry in the wet end of the paper making process, or surface sizing in which the sizing dispersions are applied at the press or the coater. This invention may also be used in one or both parts of a two-part sizing system. For example, one part may be mixed internally with the wood pulp and a second part applied at the size press, a common practice in papermaking.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. All parts or percentage are by weight unless otherwise indicated.

The entire disclosures of all patents and publications, cited above and below, are hereby incorporated by reference as though set forth in full herein.

EXAMPLE 1

Preparation of Sizing Dispersion

An AKD sizing dispersion was prepared as follows. 5.6 g of an unmodified sodium lignosulfonate containing about 6% sulfonate sulfur (Norlig 12F® Lignotech, USA Inc., Wisconsin), and 1269.2 g water were added to a jet cooker. Stirring was performed until the Norlig 12F® was completely dissolved. 55.8 g of a cationic starch (Sta Lok 169®, A. E. Staley Mfg. Co., Illinois), was added to the cooker. The cooker was steam-heated to 95° C. for 60 minutes and stirring was applied inside the cooker during the cooking. The mixture formed is a mixed dispersant system. This mixture was then cooled to 70° C., and 222.8 of AKD (Aquapel 364®, Hercules Incorporated, Delaware), and 1.2 g of biocide (AMA 424®, Vinings Indus., Georgia), were added. Stirring was applied at 70° C. for 5 minutes. Then the mixture was homogenized under pressure of 211 kg/cm$^2$ with a 15 M Gaulin Laboratory Homogenizer (Gaulin Corporation, Massachusetts), then rapidly cooled to 25° C. After cooling, AKD sizing dispersion (I) was prepared by adding 445.6 g of a 48.5% alum solution (General Chemical Co., New Jersey) while stirring.

EXAMPLE 2

Preparation of Sizing Dispersions

Similarly, AKD sizing dispersions made with sodium lignosulfonate exhibiting a relatively high hydrophobicity, according to the invention, were prepared as follows. 5.6 g of a sodium lignosulfonate containing about 3.6 wt % sulfonate sulfur (Dynasperse LCD®, Lignotech USA, Incorporated, in Wisconsin), and 1269.2 g water were added to a jet cooker. Stirring was performed until the Dynasperse LCD® was completely dissolved. 55.8 g of cationic starch (Sta Lok 169®, A. E. Staley Mfg. Co., Illinois), was added to the cooker. The cooker was steam-heated to 95° C. for 60 minutes and stirring was applied inside the cooker during the cooking. The mixture formed is the mixed dispersant system. The mixture was then cooled to 70° C., and 222.8 g of AKD (Aquapel 364®, Hercules Incorporated, Wilmington, Del.), and 1.2 g of biocide (AMA 424®, Vinings Indus., Georgia), were added. Stirring was applied at the temperature 70° C. for 5 minutes. The mixture was then homogenized under pressure of 211 kg/cm$^2$ with a 15 M Gaulin Laboratory Homogenizer (Gaulin Corp., Massachusetts), then rapidly cooled to 25° C. After cooling, AKD sizing dispersion (II) was prepared by adding 445.6 g of a 48.5% alum solution sold by General Chemical Corp. (New Jersey) while stirring. Similarly, AKD sizing dispersion (III) was prepared by adding 222.8 g of the alum solution and dispersion (IV) was prepared by adding 89.1 g of the alum solution. Sizing dispersion (V) was made similarly to the dispersion (II) except that no Dynasperse LCD® was added. Sizing dispersion (VI) was made similar to the dispersion (II) except that no cationic starches were added.

EXAMPLE 3

The dispersions prepared in Examples 1 and 2 were used to run viscosity stability tests. The viscosity was measured using a Brookfield DV-II Viscometer with a #1 spindle at 60 RPM. The viscosities of the dispersions were measured immediately after the dispersions were made. The viscosities then were measured again after 2 week aging at 32° C. The results are summarized in Table 1. The viscosities of the dispersions were stable for samples I to IV, which used the mixed dispersant system, while the dispersions were either gelled or separated for samples V and VI which used cationic starch or Dynasperse LCD® separately as the sole dispersant.

TABLE 1

| Dispersion No. | Viscosity (original cp) | Viscosity (2 weeks, cp) |
|---|---|---|
| I | 40 | 61 |
| II | 31 | 27 |
| III | 49 | 61 |
| IV | 41 | 85 |
| V | 32 | Gelled |
| VI | 11 | Separated |

EXAMPLE 4

The dispersions prepared in Examples 1 and 2 were used to run stratification stability tests. Typically, 1.5 g of the dispersion was placed on an aluminum disk and heated for 45 minutes in a 150° C. oven. The percentage of the non-volatile content in the dispersion measured by such a heating method is called the "bottom total solid %" (BTS %). The BTS % of the dispersions was measured immediately after the dispersion was made. Then 100 grams of the dispersion was placed in a 100-gram glass bottle. The BTS % of the sample from the bottom of the bottle was measured again after 2 weeks aging at 25° C. If the difference between the two BTS % data is small, the dispersion is considered as stable from stratification. The results are summarized in Table 2. The dispersion I, which was made from the mixed dispersant system of the unmodified sodium lignosulfonate and the cationic starch, had a high degree of stratification after the two week aging. However, the samples II to IV, which were made from the mixed dispersant system of the hydrophobic sodium lignosulfonate and the cationic starch, were stable from stratification. The dispersion V, which was made from the cationic starch as the sole dispersant, had low stratification but it failed the viscosity stability test as showed in Table 1. The dispersion VI, which was made from the hydrophobic sodium lignin sulfonate as the sole dispersant, was separated.

TABLE 2

| Dispersion No. | BTS % (original) | BTS % (2 weeks, Bottom) |
|---|---|---|
| I | 20.5 | 18.7 |
| II | 20.5 | 20.0 |
| III | 18.7 | 18.6 |
| IV | 16.6 | 16.4 |
| V | 17.0 | 16.9 |
| VI | 16.2 | Separated |

EXAMPLE 5

The dispersions II, III and IV made in Example 2 and a control sample Hercon 70® paper sizing dispersion made by Hercules Incorporation in Delaware were used to run drainage efficiency tests. The tests were performed with a Canadian Standard Freeness (CSF) Tester according to method described in SCAN-C21:65. Recycled old corrugated containers (OCC) pulp refined to 400 CSF was mixed in water to make 0.2% slurry. The size dispersion was added as 0.04% of AKD based on the dry pulp weight. 0.50% Sta lok 400® starch (A. E. Staley Manufacturing Co., Illinois), and 0.025% Reten-1523H® (Hercules Incorporated, Delaware) were also added to the slurry. The pH of the slurry was adjusted to 7.0. The freenesses (CSF) of the mixtures were measured and the results are summarized in Table 3. Compared with the control Hercon 70®, dispersion II to IV showed significant improvement on drainage.

TABLE 3

| Dispersion No. | CSF (ml) |
|---|---|
| II | 510 |
| III | 465 |
| IV | 500 |
| Hercon 70 ® | 420 |

EXAMPLE 6

The aqueous dispersions II, III and IV of the Example 2, together with a control sample Hercon 70® were used to prepare internally sized paper on a pilot paper machine. The paper was made from a recycled old corrugated containers (OCC) pulp beaten to a Canadian standard freeness of 350 and formed into sheets having a basis weight of 40 pounds/3000 $ft^2$ at a pH of 7.0. The paper sheets were dried to 5.0% moisture level at the reel. The size dispersion was added to the thick stock just prior to dilution at the fan pump. The addition level is from 0.0225% to 0.068% of AKD based on the dry paper weight. 38.0% sodium sulfate (Haviland Chemical Co., Michigan), 0.15% alum (General Chemical Corp, New Jersey), and 0.025% Reten-1523H® (Hercules Incorporated) were also used for the paper making. The paper sheets were dried to 5.0% moisture level at the reel. Sizing was tested using the Hercules Size Test (HST). In the HST test, a sheet of sized paper is laid under an ink solution containing 1% of formic acid and 1.2% of Naphthol Green B. The reflectance of the paper on the opposite side of the solution is initially measured and is then monitored as it falls due to the ink penetration. The HST time (in seconds) is the time taken for the reflectance to fall to 80% of its initial value. Table 4 summarizes the sizing results. Results from Table 4 indicated that dispersions II to IV had significantly higher sizing than the control Hercon 70® at both the high and low AKD loading levels.

TABLE 4

| Dispersion No. | AKD % | HST (s) |
|---|---|---|
| II | 0.0225 | 71 |
| III | 0.0225 | 99 |
| IV | 0.0225 | 81 |
| Hercon 70 ® | 0.0225 | 48 |
| II | 0.045 | 1089 |
| III | 0.045 | 1182 |
| IV | 0.045 | 1348 |
| Hercon 70 ® | 0.045 | 704 |

From the foregoing descriptions, one skilled in the art can easily ascertain the essential characteristics of this invention, and without departing from the spirit and scope thereof, can make various changes and modifications of the invention to adapt it to various usages and conditions.

What is claimed is:

1. An aqueous composition comprising:

cellulose-reactive size;

dispersant system comprising sodium lignosulfonate having less than about 5.9 wt % sulfonate sulfur based on the total weight of the sodium lignosulfonate, and at least one of cationic dispersant and non-ionic dispersant; and at least one salt containing at least one metal element.

2. The composition of claim 1, wherein the lignosulfonate comprises less than about 5 wt % sulfonate sulfur based on the total weight of the sodium lignosulfonate.

3. The composition of claim 2, wherein the lignosulfonate comprises less than about 4.5 wt % sulfonate sulfur based on the total weight of the sodium lignosulfonate.

4. The composition of claim 3, wherein the lignosulfonate comprises less than about 4 wt % sulfonate sulfur based on the total weight of the sodium lignosulfonate.

5. The composition of claim 4, wherein the lignosulfonate comprises about 3.6 wt % sulfonate sulfur based on the total weight of the sodium lignosulfonate.

6. The composition of claim 1, wherein the salt is present in an amount such that the at least one metal element is present in an amount equivalent to, or greater than, about 0.2 wt % aluminum, based on the weight of cellulose-reactive size.

7. The composition of claim 6, wherein the salt is present in an amount such that the at least one metal element is present in an amount equivalent to, or greater than, about 0.4 wt % aluminum, based on the weight of cellulose-reactive size.

8. The composition of claim 7, wherein the salt is present in an amount such that the at least one metal element is present in an amount equivalent to, or greater than, about 1.5 wt % aluminum, based on the weight of cellulose-reactive size.

9. The composition of claim 8, wherein the salt is present in an amount such that the at least one metal element is present in an amount equivalent to, or greater than, about 3 wt % aluminum, based on the weight of cellulose-reactive size.

10. The composition of claim 9, wherein the salt is present in an amount such that the at least one metal element is present in an amount equivalent to, or greater than, about 4.4 wt % aluminum, based on the weight of cellulose-reactive size.

11. The composition of claim 10, wherein the salt is present in an amount such that the at least one metal element is present in an amount equivalent to, or greater than, about 5.5 wt % aluminum, based on the weight of cellulose-reactive size.

12. The composition of claim 11, wherein the salt is present in an amount such that the at least one metal element is present in an amount equivalent to, or greater than, about 6 wt % aluminum, based on the weight of cellulose-reactive size.

13. The composition of claim 1, wherein the salt is present in an amount such that the at least one metal element is present in an amount equivalent to, or less than, about 40 wt % aluminum, based on the weight of cellulose-reactive size.

14. The composition of claim 13, wherein the salt is present in an amount such that the at least one metal element is present in an amount equivalent to, or less than, about 30 wt % aluminum, based on the weight of cellulose-reactive size.

15. The composition of claim 14, wherein the salt is present in an amount such that the at least one metal element is present in an amount equivalent to, or less than, about 20 wt % aluminum, based on the weight of cellulose-reactive size.

16. The composition of claim 15, wherein the salt is present in an amount such that the at least one metal element is present in an amount equivalent to, or less than, about 15 wt % aluminum, based on the weight of cellulose-reactive size.

17. The composition of claim 16, wherein the salt is present in an amount such that the at least one metal element is present in an amount equivalent to, or less than, about 12 wt % aluminum, based on the weight of cellulose-reactive size.

18. The composition of claim 17, wherein the salt is present in an amount such that the at least one metal element is present in an amount equivalent to, or less than, about 10 wt % aluminum, based on the weight of cellulose-reactive size.

19. The composition of claim 18, wherein the salt is present in an amount such that the at least one metal element is present in an amount equivalent to, or less than, about 8 wt % aluminum, based on the weight of cellulose-reactive size.

20. The composition of claim 4, wherein the salt is present in an amount such that the at least one metal element is present in an amount equivalent to from about 0.2 wt % to about 40 wt % aluminum, based on the weight of cellulose-reactive size.

21. The composition of claim 20, wherein the salt is present in an amount such that the at least one metal element is present in an amount equivalent to from about 0.4 wt % to about 30 wt % aluminum, based on the weight of cellulose-reactive size.

22. The composition of claim 21, wherein the salt is present in an amount such that the at least one metal element is present in an amount equivalent to from about 1.5 wt % to about 20 wt % aluminum, based on the weight of cellulose-reactive size.

23. The composition of claim 22, wherein the salt is present in an amount such that the at least one metal element is present in an amount equivalent to from about 3 wt % to about 15 wt % aluminum, based on the weight of cellulose-reactive size.

24. The composition of claim 23, wherein the salt is present in an amount such that the at least one metal element is present in an amount equivalent to from about 4.4 wt % to about 12 wt % aluminum, based on the weight of cellulose-reactive size.

25. The composition of claim 24, wherein the salt is present in an amount such that the at least one metal element is present in an amount equivalent to from about 5.5 wt % to about 10 wt % aluminum, based on the weight of cellulose-reactive size.

26. The composition of claim 25, wherein the salt is present in an amount such that the at least one metal element is present in an amount equivalent to from about 6 wt % to about 8 wt % aluminum, based on the weight of cellulose-reactive size.

27. An aqueous composition comprising:

cellulose-reactive size;

dispersant system comprising anionic dispersant and at least one of cationic dispersant and non-ionic dispersant; and at least one salt containing at least one metal element, wherein the salt is present in an amount such that the at least one metal element is present in an amount equivalent to, or greater than, about 5.5 wt % aluminum, based on the weight of cellulose-reactive size.

28. The composition of claim 27, wherein the cellulose-reactive size comprises at least one of ketene dimer and ketene multimer.

29. The composition of claim 28, wherein the ketene dimer comprises at least one of alkenyl ketene dimer and alkyl ketene dimer.

30. The composition of claim 27, wherein the cellulose-reactive size comprises at least one of alkenyl succinic anhydride and stearic anhydride.

31. The composition of claim 27, wherein the cellulose-reactive size comprises organic epoxide containing from about 12 to about 22 carbon atoms, acyl halide containing from about 12 to about 22 carbon atoms, fatty acid anhydride from fatty acid containing from about 12 to about 22 carbon atoms, or organic isocyanate containing from about 12 to about 22 carbon atoms.

32. The composition of claim 28, wherein the ketene dimer or ketene multimer comprises a compound of Formula I:

I

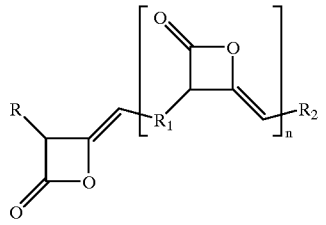

where n is an integer of from 0 to about 20, R and $R_2$ are the same or different and are saturated or unsaturated hydrocarbyl groups having from about 6 to about 24 carbon atoms, and $R_1$ is a saturated or unsaturated hydrocarbyl group having from about 2 to about 40 carbon atoms.

33. The composition of claim 32, wherein n is from 0 to about 6.

34. The composition of claim 33, wherein n is from 0 to about 3.

35. The composition of claim 34, wherein n is 0.

36. The composition of claim 32, wherein R is a saturated or unsaturated hydrocarbyl group having from about 10 to 20 carbon atoms.

37. The composition of claim 36, wherein R is a saturated or unsaturated hydrocarbyl group having from about 14 to 16 carbon atoms.

38. The composition of claim 32, wherein $R_2$ is a saturated or unsaturated hydrocarbyl group having from about 10 to 20 carbon atoms.

39. The composition of claim 38, wherein $R_2$ is a saturated or unsaturated hydrocarbyl group having from about 14 to 16 carbon atoms.

40. The composition of claim 32, wherein $R_1$ is a saturated or unsaturated hydrocarbyl group having from about 4 to 20 carbon atoms.

41. The composition of claim 27, wherein the anionic dispersant comprises polymeric dispersant containing sulfate or sulfonate.

42. The composition of claim 27, wherein the anionic dispersant comprises formaldehyde condensate of sodium naphthalene sulfonate, formaldehyde condensate of sodium alkylnaphthalene sulfonate, formaldehyde condensate of sodium phenol sulfonate, formaldehyde condensate of sodium phenol sulfate, and lignosulfonate.

43. The composition of claim 42, wherein the lignosulfonate comprise hydrophobic lignosulfonate.

44. The composition of claim 43, wherein the hydrophobic lignosulfonate comprises hydrophobic sodium lignosulfonate having less than about 5.9 wt % sulfonate sulfur based on the total weight of the sodium lignosulfonate.

45. The composition of claim 44, wherein the hydrophobic sodium lignosulfonate comprises hydrophobic sodium lignosulfonate having less than about 5 wt % sulfonate sulfur based on the total weight of the sodium lignosulfonate.

46. The composition of claim 45, wherein the hydrophobic sodium lignosulfonate comprises hydrophobic sodium lignosulfonate having less than about 4.5 wt % sulfonate sulfur based on the total weight of the sodium lignosulfonate.

47. The composition of claim 46, wherein the hydrophobic sodium lignosulfonate comprises hydrophobic sodium lignosulfonate having less than about 4 wt % sulfonate sulfur based on the total weight of the sodium lignosulfonate.

48. The composition of claim 47, wherein the hydrophobic sodium lignosulfonate comprises hydrophobic sodium lignosulfonate having less than about 3.6 wt % sulfonate sulfur based on the total weight of the sodium lignosulfonate.

49. The composition of claim 27, wherein the anionic dispersant is present in an amount of from about 0.02 to about 20 wt % of the weight of the cellulose-reactive size.

50. The composition of claim 49, wherein the anionic dispersant is present in an amount of from about 0.4 to about 7 wt % of the weight of the cellulose-reactive size.

51. The composition of claim 50, wherein the anionic dispersant is present in an amount of from about 0.9 to about 3 wt % of the weight of the cellulose-reactive size.

52. The composition of claim 27, wherein the at least one of cationic dispersant and non-ionic dispersant comprises cationic dispersant.

53. The composition of claim 52, wherein the cationic dispersant comprises cationically modified starch, cationically modified guar, or low charge cationic polymer.

54. The composition of claim 53, comprising cationically modified starch in an amount of from about 0.4 to about 400 wt % of the weight of the cellulose-reactive size.

55. The composition of claim 54, comprising cationically modified starch in an amount of from about 2 to about 100 wt % of the weight of the cellulose-reactive size.

56. The composition of claim 55, comprising cationically modified starch in an amount of from about 10 to about 30 wt % of the weight of the cellulose-reactive size.

57. The composition of claim 27, wherein the at least one of cationic dispersant and non-ionic dispersant comprises nonionic dispersant.

58. The composition of claim 27, wherein the salt comprises at least one metal of Groups I, II, III, IV, V, and Transition Elements of the Periodic Table.

59. The composition of claim 58, wherein the salt comprises at least one of aluminum, magnesium, calcium, and barium.

60. The composition of claim 59, wherein the salt comprises aluminum salt of the formula $Al_x(SO_4)_y(H_2O)_z$, wherein x is 1 to 3, y is 1 to 4, and z is 0 to 20.

61. The composition of claim 60, wherein the aluminum salt is aluminum sulfate.

62. The composition of claim 59, wherein the salt comprises aluminum salt of the formula $Al_n(OH)_mX_{3n-m}$, wherein X is a negative ion, n and m are integers greater than 0, and 3n−m is greater than 0.

63. The composition of claim 62, wherein the negative ion comprises chloride or acetate.

64. The composition of claim 63, wherein the aluminum salt comprises polyaluminum chloride.

65. The composition of claim 27, wherein the salt is present in an amount such that the at least one metal element is present in an amount equivalent to from about 5.5 wt % aluminum to about 10 wt % aluminum, based on the weight of cellulose-reactive size.

66. The composition of claim 65, wherein the salt is present in an amount such that the at least one metal element is present in an amount equivalent to from about 6 wt % aluminum to about 8 wt % aluminum, based on the weight of cellulose-reactive size.

67. An aqueous composition comprising:

at least one of ketene dimer and ketene multimer, dispersant system comprising hydrophobic sodium lignosulfonate and cationically modified starch; and aluminum sulfate.

68. An aqueous composition for sizing a paper product, produced by combining cellulose-reactive size;

dispersant system comprising anionic dispersant and at least one of cationic dispersant and non-ionic dispersant; and at least one salt containing at least one metal element, wherein the salt is present in an amount such that the at least one metal element is present in an amount greater than, or equivalent to, 5.5 wt % aluminum, based on the weight of cellulose-reactive size.

69. A method for sizing a cellulose-based product, comprising adding:

cellulose-reactive size;

dispersant system comprising anionic dispersant and at least one of cationic dispersant and non-ionic dispersant; and at least one salt containing at least one metal element, wherein the salt is present in an amount such that the at least one metal element is present in an amount greater than, or equivalent to, 5.5 wt % aluminum, based on the weight of cellulose-reactive size, to cellulosic material.

70. The method of claim 69, wherein the cellulosic material comprises pulp.

71. The method of claim 69, wherein the cellulosic material comprises the surface of a paper product.

72. A kit comprising for sizing a cellulose-based product, the kit comprising:

cellulose-reactive size;

dispersant system comprising anionic dispersant and at least one of cationic dispersant and non-ionic dispersant; and at least one salt containing at least one metal element, wherein the salt is present in an amount such that the at least one metal element is present in an amount greater than, or equivalent to, 5.5 wt % aluminum, based on the weight of cellulose-reactive size.

* * * * *